United States Patent [19]

Wilson

[11] 4,125,095

[45] Nov. 14, 1978

[54] CARBURETORS FOR INTERNAL COMBUSTION ENGINES

[76] Inventor: Jack C. Wilson, Unit 1/2 First Ave., Glenelg East, Australia, 5045

[21] Appl. No.: 698,787

[22] Filed: Jun. 22, 1976

[30] Foreign Application Priority Data

Jun. 25, 1975 [AU] Australia ..... PC2118

[51] Int. Cl.[2] ..... F02M 13/06

[52] U.S. Cl. ..... 123/106; 123/123; 261/DIG. 56

[58] Field of Search ..... 123/100, 106, 123; 261/44 R, DIG. 56, DIG. 58

[56] References Cited

U.S. PATENT DOCUMENTS

| | | | |
|---|---|---|---|
| 1,857,466 | 5/1932 | Mallory | 123/100 |
| 3,334,876 | 8/1967 | Shorrock | 261/DIG. 56 |
| 3,861,366 | 1/1975 | Masaki et al. | 123/106 |
| 3,949,025 | 4/1976 | Englert et al. | 261/DIG. 58 |
| 4,021,513 | 5/1977 | Ullman | 261/DIG. 56 |

*Primary Examiner*—Charles J. Myhre
*Assistant Examiner*—Craig R. Feinberg
*Attorney, Agent, or Firm*—McNenny, Pearne, Gordon, Gail, Dickinson & Schiller

[57] ABSTRACT

An arrangement for controlling of carburation for an internal combustion engine in which the constriction to draw fuel into the air stream is controlled by a mechanism which controls the position of the constricting members proportionately to the speed of the output of the engine. The fuel supply is also controlled in proportion to the degree of constriction.

4 Claims, 9 Drawing Figures

CARBURETORS FOR INTERNAL COMBUSTION ENGINES

This invention relates to an arrangement for controlling of carburation for an internal combustion engine.

BACKGROUND OF INVENTION

It is conventional to supply an air fuel mixture into an internal combustion engine by using an air stream passing through a constriction in which fuel is drawn into the air stream by reason of the vacuous effect caused by such constriction.

It is known to provide means by which the degree of constriction can be varied for instance by using the vacuous effect itself to draw the constricting members against resilient retention into a greater or lesser constricting effect.

I have discovered that substantial improvement in both economy of fuel usage for a given output of engine and furthermore some increased output of engine performance while achieving such fuel economy can be achieved at least in certain instances by use of a particular arrangement and it is therefore the object of this invention to propose an arrangement for controlling of carburation for an internal combustion engine which provides an advantage either in relation to economy or in relation to engine performance and in some instances and indeed as a result of improved engine performance improvements relating to pollution content of the exhaust.

STATEMENT OF THE INVENTION

In one form the invention could be said to reside in an arrangement for controlling of carburation for an internal combustion engine wherein fuel is drawn into an air stream by a constriction of a stream of the air so as to be effective in causing a drawing into the air stream of fuel from an outlet and constriction means arranged so that the degree of said effective constriction can be varied, the arrangement being characterized in that the degree of said effective constriction is variable and is varied in accord with changes in engine speed output so that with greater engine speed output there shall be lesser effective constriction and with lesser engine speed output there shall be greater effective constriction.

It has been discovered that whereas varying the effective degree of constriction is not new in itself, that there is substantial advantage in making such variation of constriction subject to the speed output of the engine.

The controls governing the fuel air ratio have, of course, separate adjustments and it has been found most desirable that in conjunction with the variation of the constriction, that there be a valve controlling the resistance to fuel supply through a supply conduit into the air stream and that such control shall be coupled also therefore to the means responsive to variation of engine speed so that for a lesser constriction there will be lesser constriction on the fuel supply and conversely with a greater constriction there will be a greater constriction on the fuel supply so as to assist in maintaining the desirable ratio.

In a preferred arrangement, the effective constriction is achieved by a vane or vanes which are positioned so as to act across a throat through which the air stream shall pass.

In a preferred arrangement, the throat has a cross member through which fuel is supplied and arranged to issue therefrom and there are two vanes one to each side of the cross member each of the vanes being controlled in its position by means responsive to a change in the engine output speed and there being also a control linkage controlling fuel supply so that this is varied in relation to change in engine speed.

In a preferred arrangement, the vanes are one to each side of the cross member and there are a series of fuel outlets positioned along the cross member the shape of the throat in cross section being generally rectangular.

Under conventional driving conditions for instance using the internal combustion engine as the driving unit of a motor car, when the engine becomes subject to greater load, this will normally slow the engine down and this will normally reduce the air flow rate through the conventional throat of a conventional carburetor. This then will cause a change in the fuel air mixture ratio and can also have an effect on the distribution of the fuel into the air stream so that the mixture becomes leaner as the engine comes under load.

It is found however according to this invention, that in the event of an engine coming under load, with the speed being reduced, the constriction is narrowed or made more effective together with a comparable change in the fuel supply resistance so that the mixture reaching the engine remains a correct mixture for engine operating conditions.

In this event then, the engine will sustain its load and is more likely to sustain its revolutions and of course it means that the engine will not only operate more efficiently, but it will appear to produce in some instances a greater effective output power.

It is not clear that all the ramifications of the device or the arrangement described or the feature of this invention are understood as to their importance nor is it clear that the deficiency of previous systems are as yet fully understood.

The feature of this invention has come by way of discovery that such an arrangement produces substantially improved performance at least under some operating conditions and in some engines and has therefore shown itself to be of substantial importance.

It is of course realised that with a more efficient engine, the quantity of pollution emitted from the engine will be less simply by reason of more efficient and more accurately controlled burning of the fuel and secondly when the engine is idle, the conditions governing the idle mixture ratio, are accurately controllable with vanes that are variable in position as described. This means of course that pollution can be substantially reduced in one of the generally considered most critical operating conditions of the engine.

For a better understanding of the invention and particular aspects of the invention, a preferred embodiment shall be described incorporating the invention or features of the invention with the assistance of drawings in which FIG. 1 is a schematic illustration intended to show the principle of the perhaps main concept of the invention, FIG. 2 is a side elevation of the embodiment partly schematic showing the device for achieving a response to a change in speed of engine output coupled to a carburetor of a type presently the preferred type incorporating the invention FIG. 3 is an end elevation of the carburetor portion of the embodiment as shown in FIG. 2.

Figures 1, 2, 3:
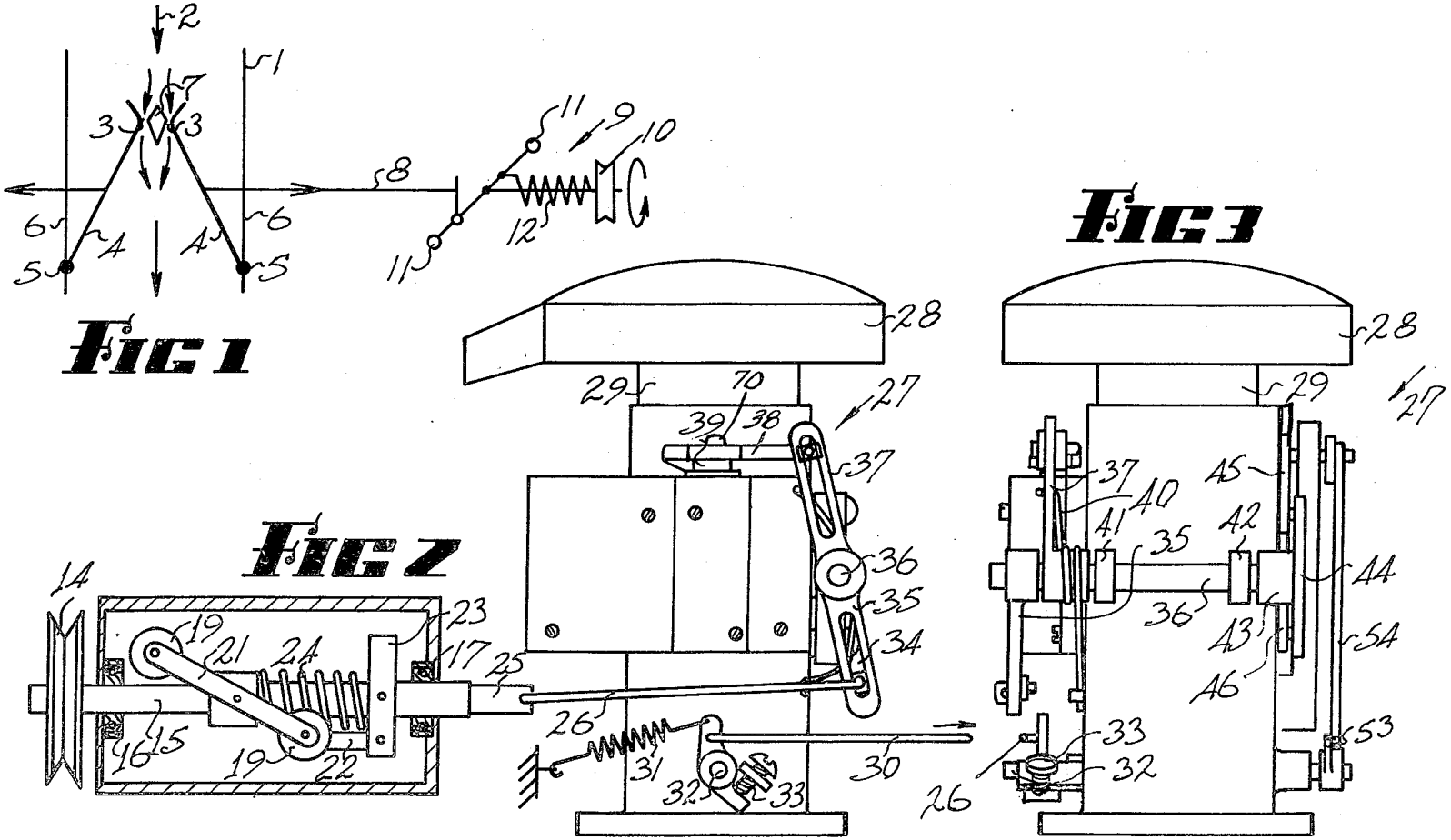

Referring now in particular to the drawings, in FIG. 1 which is the schematic illustration, there is shown a carburetor 1 with an air stream 2 caused to pass between an effective constriction 3 caused by vanes 4 in each case being supported pivotally at 5 to the wall 6 of the throat so that fuel in the form in this case at least of aerated liquid fuel can pass through apertures positioned in each side of the cross member 7.

The position of each of the vanes 4 is controlled so that each vane will act synchronously with the other and will move away or together at the same time and such control of the position of the vanes is by way of linkage 8 which is coupled to a device 9 which is driven schematically through pulley 10 at the output speed of the engine so that weight 11 will spin out further against resilient spring tension 12 so that with greater speed of rotation, there will be greater force exerted through linkage 8 on the vanes 4 and the criteria are selected so that it is the position of the vanes that is controlled as a factor of the engine output speed.

The term "engine output speed" is intended of course to normally refer to the rotational output speed of the crankshaft of a traditional multi cylindered internal combustion engine but it is appreciated that there are a variation of differing types of engine and it is not intended of course that it shall be the speed of the engine relative for instance to the ground rather than the internal speed of the engine that is important. The term "engine output speed" would therefore normally mean the direct rotational output speed of a crankshaft to which reciprocating pistons are directly coupled. The invention is not considered as to be limited to this application but it is expected that it could apply to any type of internal combustion engine.

As indeed with any practical apparatus, there are delays in response in changing the position of the vanes in response to change of engine speed but this is inevitable with practical devices and at least in the preferred embodiment there has been found to be substantial advantage even though there are these necessarily built in time delays.

Referring now to the embodiment and in particular to FIG. 2, there is shown a device 13 which will translate the rotational engine speed output into a relative position which can control the position of vanes and accordingly this device includes a pulley 14 which is intended to be rotatably driven by direct connection to a similar pulley driven by the direct connection from the crankshaft of the engine.

The pulley 14 is supported on a shaft 15 which is rotatably supported by bearings 16 and 17 within a housing 18 and coupled so as to be rotated with the shaft are two weights 19 and 20 supported by a pivotally supported lever arm 21 so that by more rapid rotation of the shaft 15, the weights 19 and 20 will tend to be positioned further from the access of the shaft.

There is a coupling 22 attached to a sliding collar 23 which is pulled against compression of spring 24 when there is rotation of the shaft 15. The effect of the sliding of the collar 23 is to draw in shaft 25 which is rotatably coupled to the collar 23 and also of course free to rotate separately from rotation of the shaft 15 by means which are not shown in the drawing but so that linkage 26 will be varied in position along its longitudinal length by reason of a change in rotational velocity of the shaft 15 but of course will not rotate with this shaft by reason of the rotatable connection.

We thus have in the device 13 a device which will alter the position of the control member 26 in accord with the change in rotational output speed of an engine.

We now refer to the carburetor 27 which is conventional in that it has an air cleaner 28 through which air is supplied to a throat 29 and there is a throttle control 30 acting against a spring 31 so as to control a throttle member by reason of rotation of shaft 32 in conventional manner. There is a control stop screw 33 again according to conventional techniques.

The control arm 26 is adjustably securable along slot 34 of arm 35 which is secured to shaft 36 and also secured to shaft 36 so as to rotate with this is an arm 37 adjustably secured to which is control linkage 38 which is coupled to a fuel control valve by way of shaft 39.

There is a spring return 40 to assist in providing a return pressure for the shaft 36 and associated components.

The shaft 36 is supported in bearing support 41 and 42 and is secured at its furthermost end in a boss 43 which is secured to lever arm 44 to which upper control lever 45 and lower control lever 46 are secured.

It will be appreciated that the upper end of lever arm 44 will move in a contra direction to the lower end of this lever arm 44 so that likewise the arms 45 and 46 will be caused to move in a contra direction and therefore pins 47 and 48 which are rotatably secured to vanes 49 and 50 will be caused to move in correspondence to the relative positions of the lever arms 45 and 46.

It will be noticed that there is a slot 51 and a slot 52 through the wall of the throat 29 to allow the said relative movement.

The side of the wall of each of the lever arms 45 and 46 at least in the vicinity of the slots 51 and 52 are flush so that they slide against the outer face of the throat 29 so as to maintain a sealing engagement therewith.

The throttle shaft 32 passes fully through the throat 29 and has a lever arm 53 coupled through a control linkage 54 which is pivotally secured at an outer end to a lever arm 55. This lever arm 55 is pivotally secured through shaft 56 to the throat 29 and has around an inner circumference, a cam shape so that upon rotation therewith, it will act to spread with substantial force lever arms 45 and 46.

The reason for this will be explained at a later time.

Figures 4, 5, 6, 6A, 7, 8:
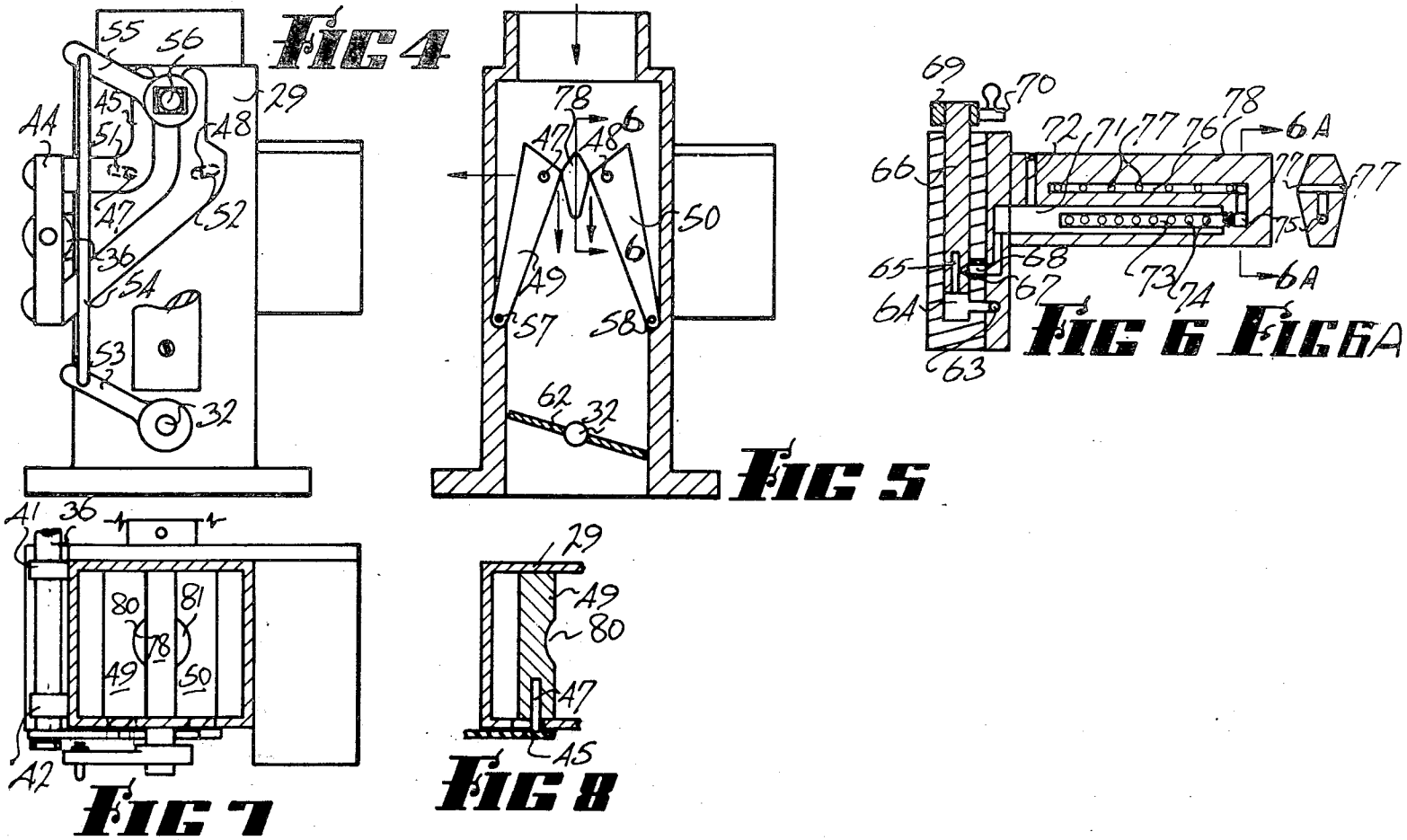
FIG. 4 is a rear view of the carburetor portion of the embodiment as shown in FIG. 1 except that an air cleaner is removed from the upper portion of the carburetor.
FIG. 5 is a cross sectional view of the same elevation as in FIG. 4 of the carburetor
FIG. 6 is a cross sectional view along the line 6—6 in FIG. 5
FIG. 6A is a cross sectional view of the device as shown in FIG. 6 along the lines 6A—6A.
FIG. 7 is a view from above shown however in part cross section of the carburetor as shown in FIG. 4
FIG. 8 is a detailed cross section showing the manner in which one of the veins is coupled through a wall through a controlling linkage.

Referring now in particular to FIG. 5, the vanes 49 and 50 are pivoted to the walls of the throat 29 at 57 and 58 and of course these are constrained to move together either toward or away from a cross member 59 from which it is intended fuel shall issue.

It will be seen therefore that the vanes between them and the cross member 59 will form a most constricted position at locations 60 and 61 this being the area of effective constriction in this arrangement.

It will further be seen in FIG. 5 that the throttle shaft 32 is supporting a throttle blade 62.

Referring now to FIG. 6 in particular, this shows in cross section and in some respects in schematic detail only the present arrangement that is used to both control the fuel supply and to provide aeration of the fuel supply before this is directed into the air stream.

Accordingly there is provided an inlet conduit 63 by which fuel passes into a chamber 64 and it then passes through a passage way 65 in a rotatable control member 66 and issues from this through a spiral slot the position of which relative to the outlet 68 will vary in accord with the rotational position of the member 66. This provides a lesser or greater gap in accord with this rotational position and in this way the resistance to flow is controlled by the position of the member 66. The member 66 has an uppermost boss 69 and a lever arm 70 for control of its rotational position.

The fuel issuing through the controlled taper gap passes into chamber 71 and has mixed therewith air through air inlet 72.

From this point it is directed into conduit 73 through one of many of the apertures in this member 74 this arrangement being designed to provide a mixing effect for the air and fuel as an initial aeration.

The fuel is then directed through passage way 75 and then into outlet conduit 76 and the series of apertures 77 which are symmetrically aligned along the length of this conduit which is within the cross member 78.

Looking from above as seen in FIG. 7, the cross sectional area of the throat 29 is generally rectangular and it will be seen that the vanes 49 and 50 have positioned centrally thereof a crescent shaped aperture 80 and 81.

The purpose of this aperture is to provide a minimum constriction which is used when the engine is expected to be in its idling position and the position of the vanes therefore generally closes off the remaining outlet apertures for the fuel.

It will be noticed hoever that the edge of the vanes is positioned against the edge of the cross member 78 so that when the vanes are to be pulled away for normal operations from the cross member, there will be an effect causing an undue gripping of the vanes against the cross member.

This effect can be counteracted so as to break this grip in the first instance by the arrangement previously described and shown in detail in FIG. 4 which particularly includes the position of the throttle acting through a cam and providing an additional spreading force between the vanes.

This then describes in general terms the arrangement as shown in the drawings and indeed the preferred embodiment.

In practice it has been found that at least with good setting up, there is a saving of up to one third of the fuel that is otherwise used in an engine under normal environmental and working conditions.

There is furthermore an advantageous increase in effective output power of the engine and there has appeared to be an advantage in starting of the engine.

There furthermore is inevitably a slight improvement in the pollution of the exhuast and it is therefore believed that the invention is of substantial importance.

It is known that other methods can be used to achieve a variation of position of the vanes in response to a change in engine output speed and it is known that this could be achieved through electrical or pneumatic means.

It is furthermore known that the method by which the constriction can be effected and changed across the throat of the air stream can be altered and it is not considered that any one particular type of vane system is necessarily the only way in which this invention can be carried out.

I claim:

1. An arrangement for controlling of carburation for an internal combustion engine wherein fuel is drawn into an air stream by constriction of a stream of the air so as to be effective in causing a drawing into the air stream of fuel from an outlet, constriction means are arranged so that the degree of effective constriction can be varied, and throttle means are provided including a throttle plate disposed in the air stream downstream of the constriction means, the arrangement being characterized in that the degree of said effective constriction is variable and is varied in accord with changes in engine speed output so that with greater engine speed output there shall be lesser effective constriction and with lesser engine speed output there shall be greater effective constriction, the effective constriction being governed by a vane arrangement positioned relative to a fuel outlet to define constriction means which is controlled by a connection to an engine output speed responsive means .

2. An arrangement for controlling of carburation for an internal combustion engine as in claim 1 in which valve control means controlling the fuel ingress into the air stream is varied also in accord with changes in engine speed output so that with a greater engine speed output there is a lesser restriction in fuel supply and with lesser engine output speed there is greater resistance to fuel supply.

3. An arrangement as in claim 1 in which air is drawn through a throat which has positioned across such throat a cross member, the fuel outlet comprises a plurality of spaced fuel outlets positioned along each side of the cross member, and positioned one to each side of the said cross member, are positioned two vanes pivotally secured relative to the throat so that by relative movement of the vanes about their pivot support relative to the fuel outlets, the effective constriction will be varied, this being between a portion of each of the vanes and the fuel outlets.

4. An arrangement for controlling of carburation for an internal combustion engine according to claim 3 further characterized in that the throttle means include an additional separating mechanism by which additional force is offered for separating the vanes from direct engagement against the cross member against a gripping bernoulli effect.

* * * * *